US011229234B2

(12) United States Patent
Tirumala et al.

(10) Patent No.: US 11,229,234 B2
(45) Date of Patent: Jan. 25, 2022

(54) ELECTRONIC CIGARETTE ATTACHMENT

(71) Applicants: Sragvi Tirumala, Freehold, NJ (US); Anthony Graffia, Morganville, NJ (US); Vincent Cordero, Freehold, NJ (US)

(72) Inventors: Sragvi Tirumala, Freehold, NJ (US); Anthony Graffia, Morganville, NJ (US); Vincent Cordero, Freehold, NJ (US)

( * ) Notice: Subject to any disclaimer, the term of this patent is extended or adjusted under 35 U.S.C. 154(b) by 110 days.

(21) Appl. No.: 16/561,657

(22) Filed: Sep. 5, 2019

(65) Prior Publication Data

US 2020/0068952 A1 Mar. 5, 2020

Related U.S. Application Data

(60) Provisional application No. 62/727,187, filed on Sep. 5, 2018.

(51) Int. Cl.

| | |
|---|---|
| ***A24F 47/00*** | (2020.01) |
| ***A24F 15/01*** | (2020.01) |
| ***A24F 15/14*** | (2006.01) |
| ***A24F 15/12*** | (2006.01) |
| *A24F 9/14* | (2006.01) |

(52) U.S. Cl.

CPC ..... *A24F 15/01* (2020.01); *A24F 15/12* (2013.01); *A24F 15/14* (2013.01); *A24F 9/14* (2013.01)

(58) Field of Classification Search

CPC ..... A24F 40/95; A24F 15/01; A24F 15/12; A24F 15/20; B65D 43/16; B65D 85/70

USPC ..... 206/236, 242, 256, 268

See application file for complete search history.

(56) References Cited

U.S. PATENT DOCUMENTS

| | | | | |
|---|---|---|---|---|
| 9,271,526 | B2 * | 3/2016 | Liu | A24F 15/12 |
| 2017/0225836 | A1 * | 8/2017 | Haines | B65D 43/26 |

OTHER PUBLICATIONS

Product information webpage for How Does a JUUL Device Work? [online at the internet <URL: https://www.juul.com/learn/device] last accessed Feb. 18, 2020.

* cited by examiner

*Primary Examiner* — King M Chu

(74) *Attorney, Agent, or Firm* — Weber Rosselli & Cannon LLP

(57) ABSTRACT

A case attachment for an electronic cigarette includes an outer housing, a detent housing slidably disposed within the outer housing and movable between a compressed position and an extended position, and a pin. A first portion of the pin is rotatably and partially supported within the outer housing and a second portion translatably and partially supported within the detent housing. The pin is movable from a first position to a second position. The biasing member is interposed between the outer housing and an end surface of the detent housing and is configured to bias the detent housing in a direction away from the end surface. The pin is configured to selectively retain the detent housing in the compressed position when in the first position and selectively retain the detent housing in the extended position when in the second position.

16 Claims, 6 Drawing Sheets

ELECTRONIC CIGARETTE ATTACHMENT

CROSS-REFERENCE TO RELATED APPLICATION

The present application claims the benefit of and priority to U.S. Provisional Patent Application Ser. No. 62/727,187, filed on Sep. 5, 2018, the entire content of which is hereby incorporated by reference herein.

TECHNICAL FIELD

The present disclosure relates generally to devices attachable to cases, and in particular, to case attachments for electronic cigarettes.

BACKGROUND

Electronic cigarettes, or e-cigarettes, have become an increasingly popular alternative to traditional tobacco products with hundreds of brands marketing e-cigarettes. Products such as blu, JUUL, LOGIC, MarkTen, NJOY, V2, VUSE, etc. heat a liquid to generate an aerosol or vapor that the user inhales to achieve a similar effect as traditional cigarettes. E-cigarettes are typically re-fillable with liquid, thereby enabling the user to carry a single device rather than a pack of individual consumable cigarettes. In this manner, e-cigarettes offer a compact package that requires very little space to store. As one can imagine, the compactness of e-cigarettes can lead to misplacement and the re-usability of e-cigarettes can lead to damage when stored in locations where the e-cigarette is prone to impact or other external forces. Therefore, there is a need for devices that enable a user to store an e-cigarette at a convenient, easily identifiable location and that provides protection for the e-cigarette from damage.

SUMMARY

The present disclosure relates to a case attachment for an electronic cigarette including an outer housing, a detent housing slidably disposed within the outer housing and movable between a compressed position and an extended position, and a first pin. A first portion of the first pin is rotatably and partially supported within the outer housing and a second portion translatably and partially supported within the detent housing. The first pin is movable from a first position to a second position. The biasing member is interposed between the outer housing and an end surface of the detent housing and is configured to bias the detent housing in a direction away from the end surface. The first pin is configured to selectively retain the detent housing in the compressed position when in the first position and selectively retain the detent housing in the extended position when in the second position.

In aspects, the case attachment may include a second pin having a first portion rotatably and partially supported within the outer housing and a second portion trsanslatably and partially supported within the detent housing, the second pin being movable from a first position to a second position.

In other aspects, the second pin may be configured to cooperate with the first pin to selectively retain the detent housing in the compressed position when in the first position and selectively retain the detent housing in the extended position when in the second position.

In certain aspects, the first pin may have a generally U-shaped configuration.

In aspects, the case attachment may include a fastening strip coupled to a portion of the outer housing.

In certain aspects, the case attachment may include a retaining slab disposed on a portion of the detent housing, the retaining slab configured to selectively couple an electronic cigarette thereto.

In other aspects, the outer housing may define an inner surface having a pair of rails disposed thereon, the pair of rails disposed in a spaced apart condition defining a channel therebetween.

In aspects, the detent housing may have a generally U-shaped configuration.

In certain aspects, the detent housing may define a first surface and an opposite second surface, the second surface defining a channel therein that is configured to slidably receive a portion of the first pin therein.

In other aspects, the channel of the detent housing may define a longitudinal axis, the channel having a first leg extending along the longitudinal axis, a second leg laterally spaced apart and parallel to the first leg, and a third leg laterally spaced apart and parallel to the second leg.

In certain aspects, the channel may include a first diagonal channel interconnecting the first and second legs, a second diagonal channel interconnecting the second leg and third leg, and a third diagonal channel interconnecting the first leg and the third leg.

In aspects, the first and second diagonal channels may define a detent, such that when the first pin is disposed therein, the detent housing is retained in the compressed position.

In accordance with another aspect of the present disclosure, a case attachment for an electronic cigarette is provided, including an outer housing, a detent housing slidably disposed within the outer housing and movable between a compressed position and an extended position, and a pin having a first portion rotatably and partially supported within the outer housing and a second portion translatably and partially supported within the detent housing, the pin being movable from a first position, where the detent housing is retained in the compressed position, to a second position, where the detent housing is retained in the extended position.

In aspects, the detent housing may define a channel therein configured to slidably receive a portion of the pin therein.

In certain aspects, the channel may include a detent, such that when the pin is disposed therein, the detent housing is retained in the compressed position.

In other aspects, the case attachment may include a fastening strip coupled to a portion of the outer housing, the fastening strip configured to selectively couple the outer housing to a cellular phone case.

In accordance with another aspect of the present disclosure, a case attachment for an electronic cigarette is provided including an outer housing, a detent housing slidably disposed within the outer housing and movable between a compressed position and an extended position, a retaining slab disposed on the detent housing, the retaining slab configured to selectively couple an electronic cigarette to the detent housing, and a pin having a first portion rotatably and partially supported within the outer housing and a second portion translatably and partially supported within the detent housing, the pin being movable from a first position, where the detent housing is retained in the compressed position, to a second position, where the detent housing is retained in the extended position.

In aspects, the detent housing may define a channel therein having a longitudinal axis, the channel including a first leg extending along the longitudinal axis, a second leg laterally spaced apart and parallel to the first leg, and a third leg laterally spaced apart and parallel to the second leg.

In certain aspects, the channel may include a first diagonal channel interconnecting the first and second legs, a second diagonal channel interconnecting the second leg and the third leg, and a third diagonal channel interconnecting the first leg and the third leg.

In other aspects, the first and second diagonal channels define a detent, such that when the pin is disposed therein, the detent housing is retained in the compressed position.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiments given below, serve to explain the principles of the disclosure, wherein.

DETAILED DESCRIPTION

Figure 1:
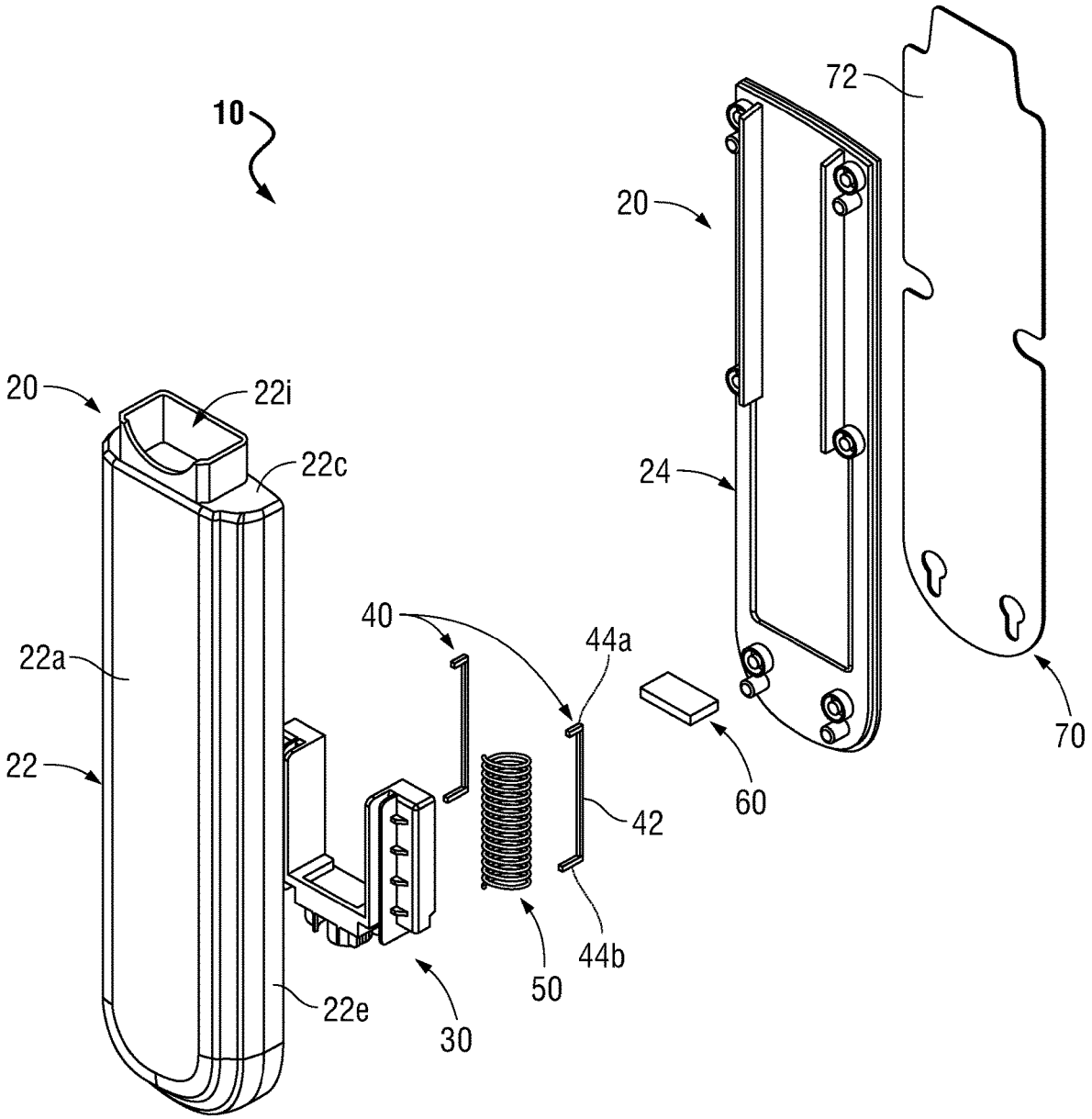
FIG. 1 is an exploded, perspective view, of a case attachment for an electronic cigarette.
Figure 2:
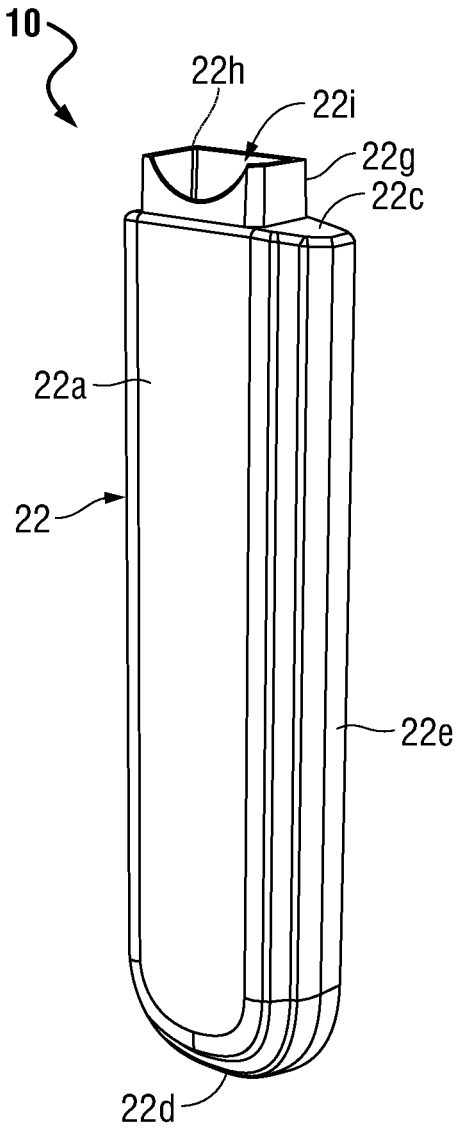
FIG. 2 is a front, perspective view, of the case attachment of FIG. 1.

The present disclosure is directed to case attachments for electronic cigarettes. As described herein, the case attachment includes a housing, a detent housing, a pair of pins, a biasing member, a retaining slab and a fastening strip. The housing includes a front half-section and an opposite rear half-section that is configured for selective attachment to the front half-section. An end surface of the front half section defines a boss having an aperture defined therethrough that is configured to receive an electronic cigarette therethrough. The front half-section defines a cavity therein that includes a pair of bosses having a bore defined therein. The bore is configured to rotatably receive a portion of a respective pin therein. A pair of rails is defined within the cavity and is configured to slidably support the detent housing. When in an assembled state, the biasing element is interposed between a portion of the front half-section and the detent housing to bias the detent housing in a first, extended position.

The rear half-section defines a pair of rails that is configured to receive the electronic cigarette therebetween to guide the electronic cigarette towards the detent housing. The detent housing defines a slot that is configured to receive a portion of the electronic cigarette therein and includes a bottom surface supporting the retaining slab. The bottom surface supports the electronic cigarette when the electronic cigarette is fully advanced within the housing such that translation of the electronic cigarette away from the aperture of the front half-section causes the detent housing to translate concomitantly with the electronic cigarette and translation of the detent housing towards the aperture causes the electronic cigarette to translate concomitantly with the detent housing. The retaining slab interacts with a magnet disposed within the electronic cigarette such that the electronic cigarette is retained within the housing when the housing is turned upside down, but is permitted to be easily removable when a user pulls on the electronic cigarette.

A rear surface of the detent housing defines a channel having a plurality of legs. The channel is configured to translatably support a portion of the pin therein such that when the detent housing is urged in a direction away from the aperture, the pin retains the detent housing in a compressed position where the electronic cigarette is completely covered. When the detent housing is once again urged in a direction away from the aperture, the pin is released from a cavity defined in the channel which permits the detent housing to be biased by the biasing element into an extended position where a portion of the electronic cigarette is exposed to the user.

Embodiments of the present disclosure are now described in detail with reference to the drawings in which like reference numerals designate identical or corresponding elements in each of the several views. In the drawings and in the description that follows, terms such as front, rear, upper, lower, top, bottom, and similar directional terms are used simply for convenience of description and are not intended to limit the disclosure. In the following description, well-known functions or constructions are not described in detail to avoid obscuring the present disclosure in unnecessary detail.

Referring now to the drawings, a case attachment for an electronic cigarette is illustrated and generally identified by reference numeral 10. As illustrated in FIG. 1, the case attachment 10 includes a housing 20, a detent housing 30, a pair of pins 40, a biasing member 50, a retaining slab 60, and a fastening strip 70.

The housing 20 includes a front half-section 22 and an opposite, rear half-section 24 that is configured for selective attachment to the front half-section 22 using any suitable means, such as fasteners (e.g., screws, clips, etc.), adhesives, welding, snap fit, amongst others. The front half-section 22 defines a generally rectangular configuration, although any suitable configuration is contemplated, such as oval, elliptical, amongst others. The front half-section 22 defines a front surface 22*a* and an opposite, rear surface 22*b* (FIG. 4), opposed end surfaces 22*c* and 22*d* extending between each of the front and rear surfaces 22*a*, 22*b* disposed on each of a first and second end portion of the front half-section 22, and opposed side surfaces 22*e* and 22*f* extending between the opposed end surfaces 22*c*, 22*d* and the front and rear surfaces 22*a*, 22*b*. An end surface 22*c* of the opposed end surfaces 22*c*, 22*d* defines a boss 22*g* thereon that extends therefrom and terminating at an end surface 22*h*. The end surface 22*h* defines an aperture 22*i* therethrough that extends through the end surface 22*c* such that an electronic cigarette is permitted to be advanced therethrough, as will be described in further detail hereinbelow.

Figure 4:
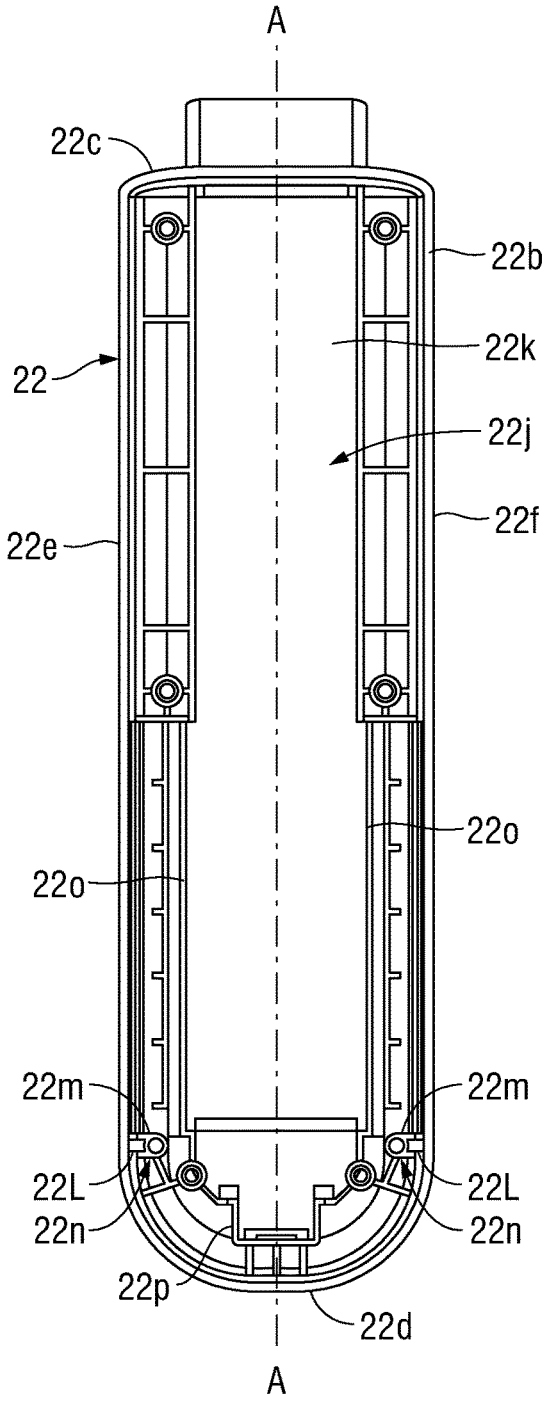
FIG. 4 is rear view of a front half-section of a housing of the case attachment of FIG. 1.
Figure 5:
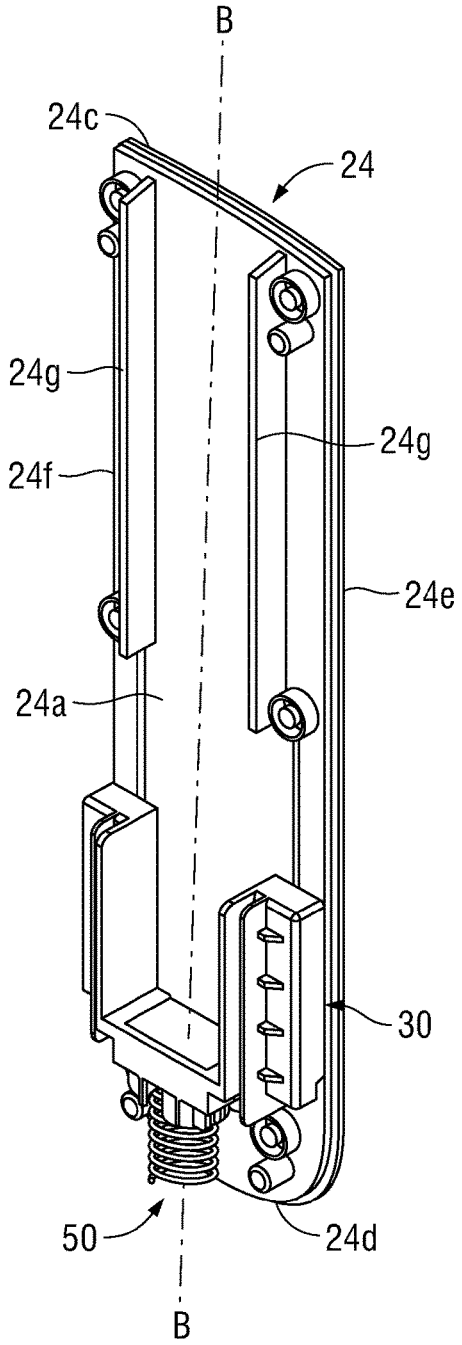
FIG. 5 is a front, perspective view, of a rear half-section of the housing of the case attachment of FIG. 1.
Figure 6:
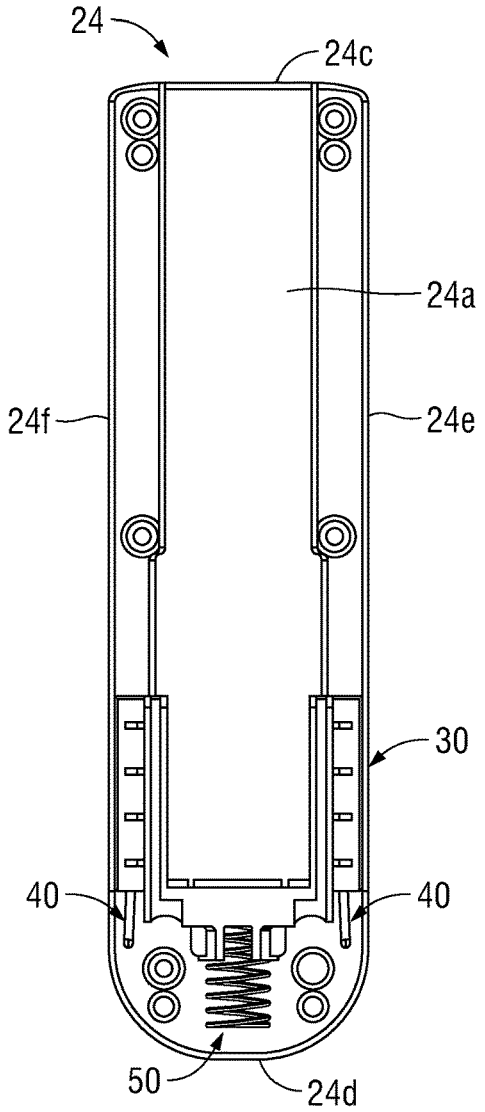
FIG. 6 is a front view of the rear half-section of FIG. 5.
Figure 7:
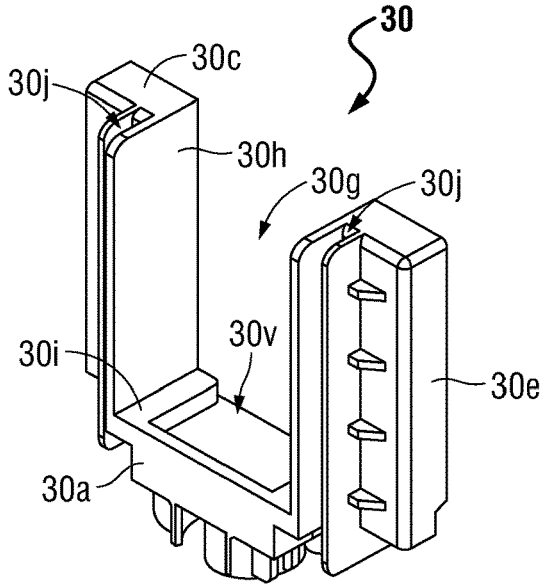
FIG. 7 is a front, perspective view, of a detent housing of the case attachment of FIG. 1.
Figure 8:
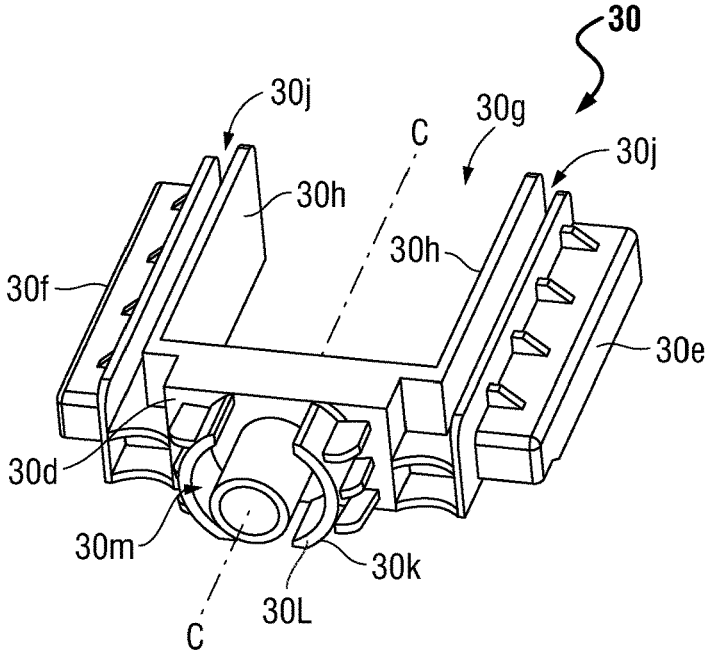
FIG. 8 is a bottom, perspective view, of the detent housing of FIG. 7.

With reference to FIG. 4, the rear surface 22*b* of the front half-section 22 defines a cavity 22*j* therein that terminates at an inner surface 22*k*. The inner surface 22*k* defines a pair of bosses or posts 22L thereon adjacent each respective side surface of the pair of opposed side surfaces 22*e*, 22*f* that extend therefrom and terminate at a top surface 22*m*. The top surface 22*m* of each of the pair of posts 22L defines a bore 22*n* therein that is configured to selectively receive a respective pin of the pair of pins 40 therein, such that each respective pin is permitted to rotate therein, as will be described in detail hereinbelow.

The inner surface 22*k* of the cavity 22*j* defines a pair of rails 22*o* therein that extend along a longitudinal axis A-A defined through the opposed end surfaces 22*c*, 22*d*. Each rail of the pair of rails 22*o* is oriented parallel to one another is disposed in spaced relation to one another. In this manner, the pair of rails 22*o* is configured to slidably support the detent housing, as will be described in further detail hereinbelow. The inner surface defines a tab 22*p* thereon disposed adjacent the end surface 22*d*. The tab 22*p* is configured and dimensioned to receive the biasing element 50 therein such that the biasing element 50 is inhibited from translating within the cavity 22*j* of the front half-section 22, as will be described in further detail hereinbelow. Although generally illustrated as having a generally U-shaped profile, it is contemplated that the tab 22*p* may include any suitable profile, such as semi-circular, planar, amongst others. Although generally illustrated as being a coil spring, it is contemplated that the biasing element 50 may be any suitable biasing element capable of biasing the detent housing 30 in a direction away from the end surface 22*d* of the first half-section 22, such as a leaf spring, gas spring, elastomer spring, amongst others.

With reference to FIGS. 1, 3, 5, and 6, the rear half-section 24 defines a configuration that is generally a complimentary to that of the front half-section 22, although it is contemplated that the rear half-section 24 may include any suitable configuration. The rear half-section 24 defines a front surface 24*a* and an opposite, rear surface 24*b* (FIG. 3) extending between opposed end surfaces 24*c* and 24*d* and opposed side surfaces 22*e* and 22*f* Although generally illustrated as having a planar configuration, it is contemplated that the rear surface 24*b* may define any suitable configuration, such as concave, convex, amongst others. The front surface 24*a* of the rear half-section 24 defines a generally planar configuration including a pair of rails 24*g* disposed thereon extending along a longitudinal axis B-B defined through the opposed end surfaces 24*c*, 24*d*. Each of the pair of rails 24*g* is oriented parallel to one another and disposed in spaced relation such that an electronic cigarette is permitted to be received therebetween. In this manner, the electronic cigarette is laterally retained between the pair of rails 25*g* and caused to translate along the longitudinal axis B-B when translated therebetween, as will be described in further detail hereinbelow.

Turning to FIGS. 1 and 7-12, the detent housing 30 defines a generally U-shaped profile having a front surface 30*a* and an opposite, rear surface 30*b* (FIG. 9) extending between a first end surface 30*c* and an opposite, second end surface 30*d* and opposed side surfaces 30*e* and 30*f*. The front and rear surfaces 30*a* and 30*b* define a slot 30*g* therethrough and extends through the first end surface 30*c*. The slot 30*g* defines a pair of opposed sidewalls 30*h* and a bottom surface 30*i*. The slot 30*g* is configured to slidably receive the electronic cigarette (not shown) therein such that the pair of opposed sidewalls 30*h* inhibit lateral translation of the electronic cigarette therein and the bottom surface 30*i* is configured to abut a surface of the electronic cigarette and inhibit longitudinal translation of the electronic cigarette relative thereto when in contact therewith (e.g., when the electronic cigarette and the bottom surface 30*i* are in contact, translation of the electronic cigarette towards the second end surface 30*d* causes the detent housing 30 to translate concomitantly with the electronic cigarette. Likewise, translation of the detent housing 30 towards the first end surface 30*c* causes the electronic cigarette to translate concomitantly with the detent housing 30, as will be described in further detail hereinbelow.

The front surface 30*a* defines a pair of channels 30*j* that extend along a longitudinal axis C-C (FIG. 8) defined through the first and second end surfaces 30*c*, 30*d*, Each channel of the pair of channels 30*j* extends through the first and second end surfaces 30*c*, 30*d* and are configured to slidably receive a portion of each respective rail of the pair of rails 22*o* of the front half-section 22. In this manner, the detent housing is permitted to translate along the axis C-C, but not rotate relative thereto.

The second end surface 30*d* of the detent housing defines a boss 30*k* extending therefrom and terminating at an end surface 30L. The end surface 30L defines an annular groove 30*m* therein that is configured to receive a portion of the biasing member 50 therein. In this manner, the annular groove 30*m* retains the biasing member 50 as the biasing member is compressed by the detent housing and inhibits the biasing member 50 from becoming disengaged from the detent housing 30.

The rear surface 30*b* of the detent housing 30 defines a pair of channels 30*n* disposed adjacent each of the opposed side surfaces 30*e*, 30*f*. Each of the pair of channels 30*n* extends along the longitudinal axis C-C and are disposed in a mirrored configuration thereabout. Therefore, only one channel of the pair of channels 30*n* will be described in detail herein in the interest of brevity.

The channel 30*n* is configured to slidably receive a respective pin of the pair of pins 40 and includes a first leg 30*o*, second leg 30*p*, and a third leg 30*q*. The first leg 30*o* is disposed adjacent the side surface 30*f* and extending along the longitudinal axis C-C. The first leg 30*o* is defined adjacent the second end surface 30*d* and extends towards the first end surface 30*c*. The second leg 30*p* is spaced apart from the first leg 30*o* away from the side surface 30*f* and is disposed adjacent the first end surface 30*d*. The third leg 30*q* is spaced apart from the second leg away from the side surface 30*f* and is disposed adjacent the first end surface 30*d*. A first diagonal channel 30*r* interconnects the first leg 30*o* and the second leg 30*p* and extends in a direction from the second end surface 30*d* towards the first end surface 30*c*. A second diagonal channel 30*s* interconnects the second leg 30*p* and the third leg 30*q* and is oriented substantially parallel to the first diagonal channel 30*r*. A third diagonal channel 30*t* interconnects the third leg 30*q* and the first leg 30*o* and extends in a direction from the first end surface 30*c* towards the second end surface 30*d*.

Figure 9:
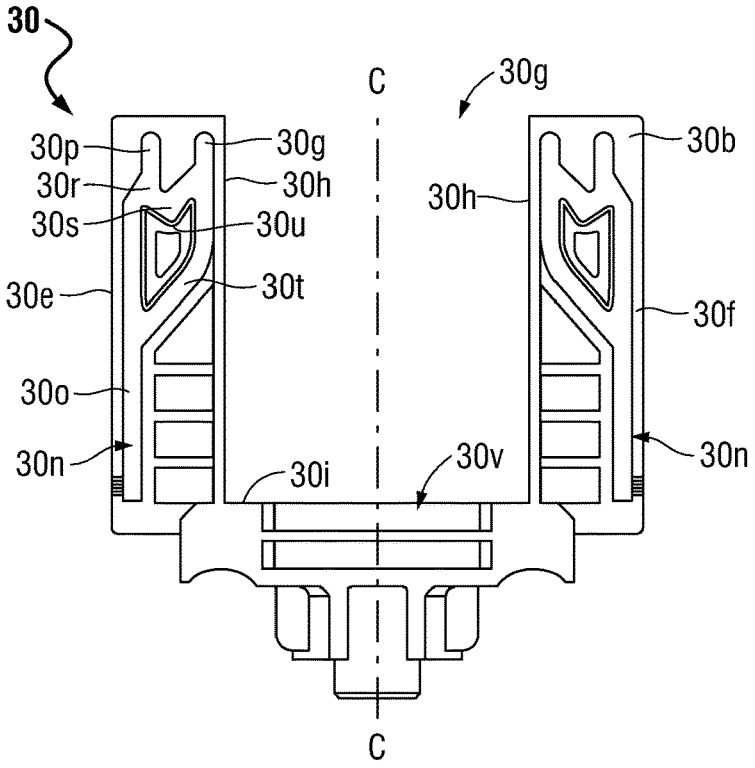
FIG. 9 is a rear view of the detent housing of FIG. 7.
Figure 10:
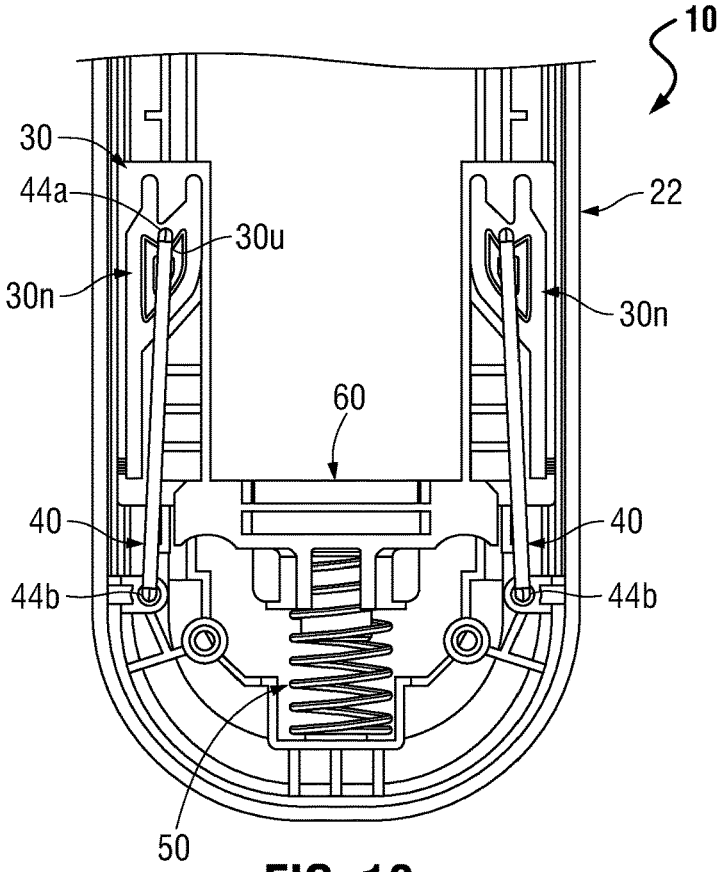
FIG. 10 is a front, cross-sectional view of the case attachment of FIG. 1, shown with the detent housing of FIG. 7 in a compressed position.

As illustrated in FIGS. 9 and 10, the first diagonal channel 30*r* and the second diagonal channel 30*s* cooperate to define a detent, such that as a respective pin of the pair of pins 40 is permitted to translate within the first diagonal channel 30*r* as the detent housing 30 is urged in a direction towards the second end surface 30*d* of the detent housing 30 and be captured within a cavity 30*u* defined by the intersection of the first diagonal channel 30*r* and the second diagonal channel 30*s* to maintain the detent housing 30 in a compressed position (e.g., in a location adjacent to the end surface 22*d* of the first half-section 22).

Returning to FIG. 1, each of the pair of pins 40 is substantially similar, thus, only one pin of the pair of pins 40 will be described in detail herein in the interest of brevity. The pin 40 defines an elongate body 42 extending between opposed end surfaces. Each of the opposed end surfaces defines a respective upturned flange 44*a* and 44*b*, respectively. Each of the upturned flanges 44*a*, 44*b* is configured to be received within one of the bores 22*n* of the pair of posts 22L of the first half-section or the channels 30*n* of the detent housing 30. In this manner, the pin 40 limits the amount of translation of the detent housing 30 within the housing 20, as will be described in further detail herein below.

Continuing with FIG. 1, the retaining slab 60 defines a generally rectangular profile, although it is contemplated that any suitable profile may be utilized, such as circular, oval, elliptical, hexagonal, amongst others. The retaining slab 60 is configured to be retained within a corresponding relief 30*v* defined in the bottom surface 30*i* of the slot 30*g* of the detent housing 30 (FIG. 7) using any suitable means, such as adhesives, welding, fasteners, amongst others. The retaining slab 60 is constructed of a ferromagnetic material such as iron, nickel, cobalt, amongst others. In this manner, the retaining slab 60 interacts with a magnet disposed within the electronic cigarette, such that when the electronic cigarette is disposed within the slot 30*g* of the detent housing 30 the magnet and retaining slab 60 cooperate to retain the electronic cigarette therein. As can be appreciated, the magnetic force generated by the magnet in the electronic cigarette is such that if the housing 20 is turned upside down, the electronic cigarette is retained therein, but is such that a user is easily able to remove the electronic cigarette from the slot 30*g* with a relatively small pulling force.

Figure 3:
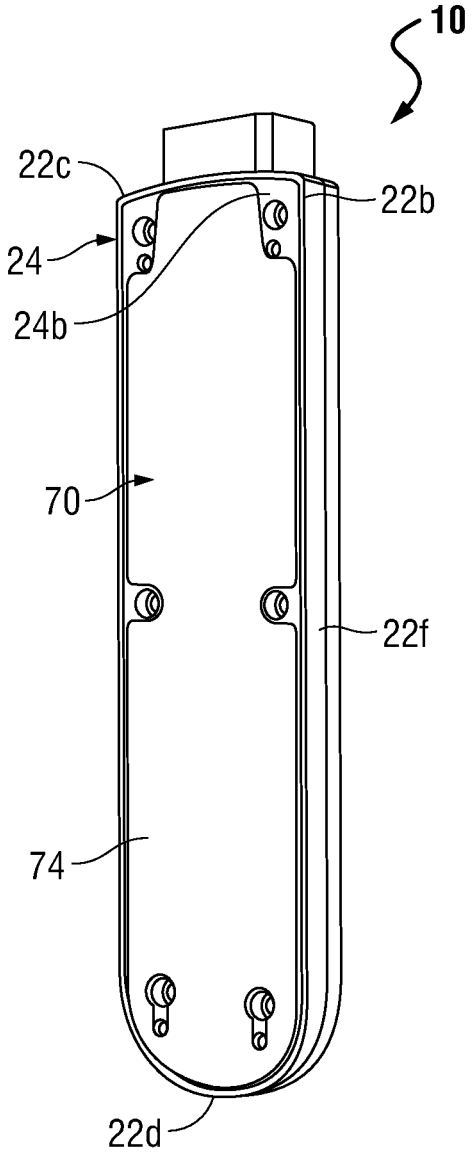
FIG. 3 is a rear, perspective view, of the case attachment of FIG. 1.

With reference to FIGS. 1 and 3, the fastening strip 70 defines a generally rectangular profile, although it is contemplated that any suitable profile may be utilized. The fastening strip 70 defines a front surface 72 and an opposite rear surface 74. Each of the front and rear surfaces 72 and 74 includes an adhesive or other suitable means for adhering the fastening strip 70 to the rear half-section 24 of the housing 20 and a cellular phone or cellular phone case. As can be appreciated, it is contemplated that the case attachment 10 may be adhered to any suitable surface, such as a tablet case, a portion of a car, a bag (briefcase, backpack, amongst others), a laptop or laptop case, amongst others. It is contemplated that each of the front and rear surfaces 72, 74 may include the same type of adhering means, or may include different adhering means. In one embodiment, the front surface 72 may include an adhesive and the rear surface 74 may include a hook and loop fastener. As can be appreciated, it is contemplated that any suitable type of adhering means may be employed.

Figure 11:
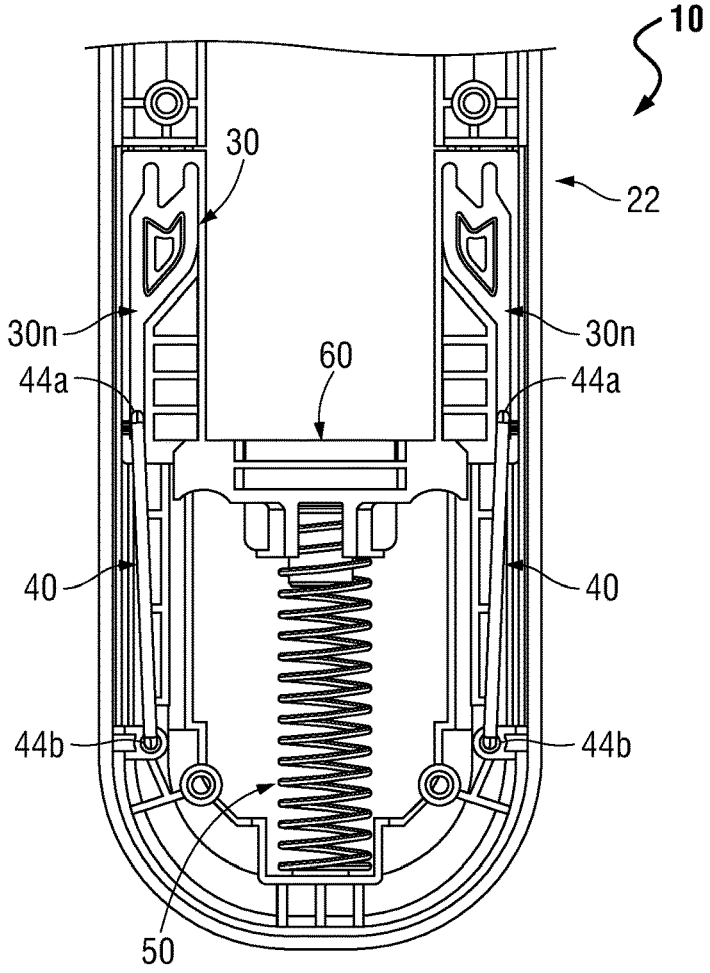
FIG. 11 is a front, cross-sectional view of the case attachment of FIG. 1, shown with the detent housing of FIG. 7 in an extended position.
Figure 12:
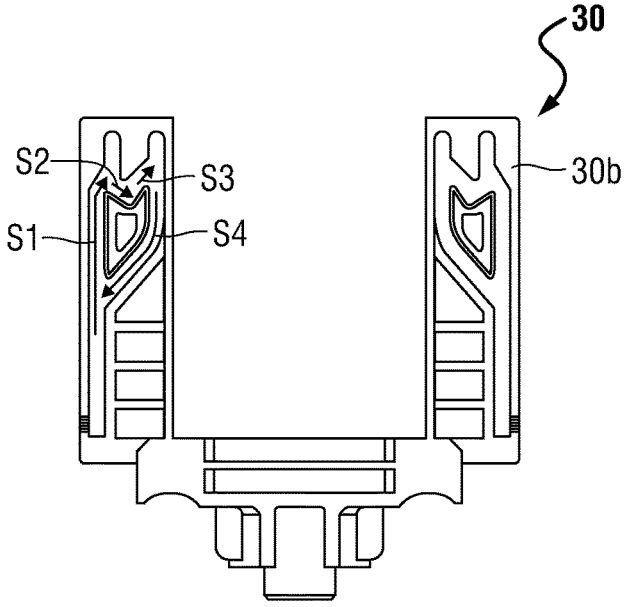
FIG. 12 is a front, schematic view, of the detent housing of FIG. 7, illustrating the path of a pin as it translates within the detent housing of FIG. 7.

With reference to FIGS. 1 and 10-12, in operation, an electronic cigarette (not shown) is initially advanced within the aperture 22*i* of the first half-section 22 (FIG. 1). Thereafter, the electronic cigarette is further advanced until a portion of the electronic cigarette abuts the bottom surface 30*i* of the slot 30*g* of the detent housing and is retained therein by the retaining slab 60 (FIG. 11). At this point, the detent mechanism 30 is in a first, extended position (FIG. 11). Continued advancement of the electronic cigarette within the housing 20 urges the detent mechanism 30 in a direction towards the end surface 22*d* of the first half-section 22 and begins to compress the biasing member 50 ("S1"). As the detent mechanism 30 is urged towards the end surface 22*d*, the upturned flange 44*a* of a respective pin 40 is translated within the first leg 30*o* of the channel 30*n* of the detent housing 30. Continued advancement of the electronic cigarette further advances the detent housing 30 such that the upturned flange 44*a* of the pin 40 is received within the first diagonal channel 30*r*, and thereafter, the second leg 30*p*. At this point, the user releases the electronic cigarette such that the biasing element 50 urges the detent housing 30 in a direction away from the end surface 22*d* of the first half-section 22 ("S2"). In this manner, the upturned flange 44*a* of the pin 40 is caused to be received within the cavity 30*u* of the channel 30*n* to inhibit the detent mechanism 30 from translating in a direction away from the end surface 22*d* of the first half-section 22 (e.g., the detent housing 30 is maintained in a compressed position (FIG. 10).

When the user wishes to remove the electronic cigarette from the housing 20, the user depresses or otherwise urges the electronic cigarette in a direction towards the end surface 22*d* of the first half-section 22, which causes the upturned flange 44*a* of the pin 40 to be received within the second diagonal channel 30*s* of the channel 30*n* of the detent housing 30 and thereafter, within the third leg 30*q* ("S3"). At this point, the user releases the electronic cigarette and the biasing element 50 urges the detent housing 30 in a direction away from the end surface 22*d* thereby causing the upturned flange 44*a* of the pin 40 to translate within the third leg 30*q* of the channel 30*n* and permitting the detent housing 30 to translate in a direction away from the end surface 22*d* ("S4"). The biasing element 50 further urges the detent housing 30 in a direction aware from the end surface 22*d* until the upturned flange 44*a* of the pin 40 is received within the first leg 30*o* of the channel 30*n* and a portion of the electronic cigarette is exposed from the aperture 22*i* of the first half-section 22. At this point, the user may grasp the electronic cigarette and remove it from the housing 20. As can be appreciated, this process may be repeated as many times as necessary or as required by the user.

It will be understood that various modifications may be made to the embodiments of the presently disclosed spinal implant. Therefore, the above description should not be construed as limiting, but merely as exemplifications of embodiments. Those skilled in the art will envision other modifications within the scope and spirit of the present disclosure.

What is claimed is:

1. A case attachment for an electronic cigarette, comprising:

an outer housing;

a detent housing slidably disposed within the outer housing and movable between a compressed position and an extended position;

a first pin having a first portion rotatably and partially supported within the outer housing and a second portion translatably and partially supported within the detent housing, the first pin being movable from a first position to a second position;

a second pin having a first portion rotatably and partially supported within the outer housing and a second portion translatably and partially supported within the detent housing, the second pin being movable from a first position to a second position; and a biasing member interposed between the outer housing and an end surface of the detent housing, the biasing member configured to bias the detent housing in a direction away from the end surface, wherein the first pin is configured to selectively retain the detent housing in the compressed position when in the first position and selectively retain the detent housing in the extended position when in the second position.

2. The case attachment according to claim 1, wherein the second pin is configured to cooperate with the first pin to selectively retain the detent housing in the compressed position when in the first position and selectively retain the detent housing in the extended position when in the second position.

3. The case attachment according to claim 1, wherein the first pin defines a generally U-shaped configuration.

4. The case attachment according to claim 1, further comprising a fastening strip coupled to a portion of the outer housing.

5. The case attachment according to claim 1, further comprising a retaining slab disposed on a portion of the detent housing, the retaining slab configured to selectively couple an electronic cigarette thereto.

6. The case attachment according to claim 1, wherein the outer housing defines an inner surface having a pair of rails disposed thereon, the pair of rails disposed in a spaced apart condition defining a channel therebetween.

7. The case attachment according to claim 1, wherein the detent housing has a generally U-shaped configuration.

8. The case attachment according to claim 7, wherein the detent housing includes a first surface and an opposite second surface, the second surface defining a channel therein that is configured to slidably receive a portion of the first pin therein.

9. The case attachment according to claim 8, wherein the channel of the detent housing defines a longitudinal axis, the channel having a first leg extending along the longitudinal axis, a second leg laterally spaced apart and parallel to the first leg, and a third leg laterally spaced apart and parallel to the second leg.

10. The case attachment according to claim 9, wherein the channel includes:

a first diagonal channel interconnecting the first and second legs;

a second diagonal channel interconnecting the second leg and the third leg; and a third diagonal channel interconnecting the first leg and the third leg.

11. The case attachment according to claim 10, wherein the first and second diagonal channels define a detent, such that when the first pin is disposed therein, the detent housing is retained in the compressed position.

12. A case attachment for an electronic cigarette, comprising:

an outer housing;

a detent housing slidably disposed within the outer housing and movable between a compressed position and an extended position, wherein the detent housing defines a channel therein, the channel defining a detent; and a pin having a first portion rotatably and partially supported within the outer housing and a second portion translatably and partially supported within the channel of the detent housing, the pin being movable from a first position, where the pin is disposed within the detent of the channel and the detent housing is retained in the compressed position, to a second position, where the pin is free from the detent of the channel and the detent housing is retained in the extended position.

13. The case attachment according to claim 12, further comprising a fastening strip coupled to a portion of the outer housing, the fastening strip configured to selectively couple the outer housing to a cellular phone case.

14. A case attachment for an electronic cigarette, comprising:

an outer housing;

a detent housing slidably disposed within the outer housing and movable between a compressed position and an extended position, wherein the detent housing defines a channel therein having a longitudinal axis, the channel defining a first leg extending along the longitudinal axis, a second leg laterally spaced apart and parallel to the first leg, and a third leg laterally spaced apart and parallel to the second leg;

a retaining slab disposed on the detent housing, the retaining slab configured to selectively couple an electronic cigarette to the detent housing; and a pin having a first portion rotatably and partially supported within the outer housing and a second portion translatably and partially supported within the channel of the detent housing, the pin being movable from a first position, where the detent housing is retained in the compressed position, to a second position, where the detent housing is retained in the extended position.

15. The case attachment according to claim 14, wherein the channel includes:

a first diagonal channel interconnecting the first and second legs;

a second diagonal channel interconnecting the second leg and the third leg; and a third diagonal channel interconnecting the first leg and the third leg.

16. The case attachment according to claim 15, wherein the first and second diagonal channels define a detent, such that when the pin is disposed therein, the detent housing is retained in the compressed position.

* * * * *